US008490575B2

(12) United States Patent
Reuter

(10) Patent No.: US 8,490,575 B2
(45) Date of Patent: Jul. 23, 2013

(54) VALVE

(75) Inventor: Martin Reuter, Dachau (DE)

(73) Assignee: Marco Systemanalyse und Entwicklung GmbH, Dachau (DE)

( * ) Notice: Subject to any disclaimer, the term of this patent is extended or adjusted under 35 U.S.C. 154(b) by 569 days.

(21) Appl. No.: 12/774,986

(22) Filed: May 6, 2010

(65) Prior Publication Data

US 2010/0284026 A1 Nov. 11, 2010

(30) Foreign Application Priority Data

May 11, 2009 (DE) ..... 10 2009 020 785

(51) Int. Cl.
*B05C 11/00* (2006.01)
*B05C 7/00* (2006.01)
*F17D 3/00* (2006.01)

(52) U.S. Cl.
USPC ..... 118/712; 118/300; 137/551

(58) Field of Classification Search
None
See application file for complete search history.

(56) References Cited

U.S. PATENT DOCUMENTS

| | | | | |
|---|---|---|---|---|
| 4,638,949 | A * | 1/1987 | Mancel | 239/307 |
| 5,415,693 | A * | 5/1995 | Yoneda et al. | 118/664 |
| 6,354,471 | B2 * | 3/2002 | Fujii | 222/380 |
| 6,896,192 | B2 * | 5/2005 | Horan et al. | 239/1 |
| 2006/0108450 | A1 * | 5/2006 | Klinkenberg et al. | 239/525 |
| 2007/0292629 | A1 | 12/2007 | Linnenkohl et al. | |
| 2008/0264496 | A1 | 10/2008 | Reuter | |

FOREIGN PATENT DOCUMENTS

| | | | |
|---|---|---|---|
| DD | 268 049 | A1 | 1/1988 |
| DE | 195 10 402 | C2 | 9/1996 |
| DE | 103 33 977 | A1 | 2/2005 |
| DE | 10 2007 020 361 | A1 | 11/2008 |
| EP | 1 502 989 | B1 | 2/2005 |
| JP | 63-66170 | U | 5/1988 |
| JP | 05-31458 | A | 2/1993 |
| JP | 06-198238 | A | 7/1994 |
| JP | 08-024749 | A | 1/1996 |
| JP | 2008-161749 | A | 7/2008 |
| WO | 2005/065844 | A1 | 7/2005 |

OTHER PUBLICATIONS

German Search Report dated Dec. 4, 2009 for corresponding German Patent Application No. 10 2009 020 785.6 filed May 11, 2009, entitled "Valve", 4 pages.

English Translation of German Search Report dated Dec. 4, 2009 for corresponding German Patent Application No. 10 2009 020 785.6 filed May 11, 2009, entitled "Valve", 5 pages.

* cited by examiner

*Primary Examiner* — Dah-Wei Yuan
*Assistant Examiner* — Charles Capozzi
(74) *Attorney, Agent, or Firm* — Lewis and Roca LLP

(57) ABSTRACT

A metering valve has a closable discharge opening from which liquid drops can be discharged, wherein a beam device is provided which generates electromagnetic radiation.

10 Claims, 1 Drawing Sheet

VALVE

CROSS-REFERENCE TO RELATED APPLICATIONS

This application claims priority to co-pending German Patent Application Serial Number 10 2009 020 785.6, filed May 11, 2009, the entirety of which is incorporated by reference herein.

BACKGROUND OF THE INVENTION

1. Field of the Invention

The present invention relates to a metering valve for the application of liquids which has a discharge opening which can be closed by a closure element and from which liquid drops are discharged when the valve is opened.

2. The Prior Art

Such a valve is known from the prior art, for example from DE 10 2007 020 361 A1, whose content is made the subject of the present invention in its entirety by reference. Such metering valves serve in automated production and production technology for the application of liquid or pasty media in the small and very small quantity ranges. In this respect, any liquid or pasty medium is understood as a liquid within the framework of the present application, whether of high or low viscosity. For the application of the liquid, the liquid is pressurized within the valve and a liquid drop is discharged from the valve on a brief opening thereof and this liquid drop is applied to a surface at speed, with the liquid drop flowing through the air between the discharge opening and the surface.

With metering valves of the aforesaid kind, the assembly of the valves is frequently time-intensive since the exact position of the impact point of the liquid drop cannot be recognized without the metering valve being put into operation, which is frequently unwanted due to the media used, for example adhesives.

BRIEF DESCRIPTION OF THE INVENTION

It is the object of the present invention to provide a metering valve in accordance with the preamble of claim 1 with which the installation costs and assembly costs can be substantially lowered.

This object is satisfied by the features of claim 1 and in particular in that the valve has a beam device which generates a beam of electromagnetic radiation in the region of the liquid drop being discharged. If this radiation is in the visible spectrum, an adjustment of the metering valve can be achieved in a particularly simple manner since in this case the visible radiation can be used as an adjustment aid to assemble and align the metering valve such that the liquid drop impacts exactly at the desired target position.

Advantageous embodiments of the invention are described in the description, in the drawing and in the dependent claims.

In accordance with a first advantageous embodiment, the optical axis of the beam device and the discharge direction of the liquid drop substantially coincide. An adjustment of the metering valve can be achieved in a particularly simple way in this manner since the generated light beam or light spot corresponds to the trajectory of the liquid drop.

It can be advantageous if the beam device has a light source and a lens which generate a visible marking in the region of the liquid drop being discharged. Such a marking can, for example, be a light spot with whose help the metering valve can be assembled or adjusted so that the desired target point is exactly impacted.

It can be advantageous for a particularly compact construction if the beam device has a lens through which at least a part of the valve extends. A circular lens can thus be used, for example, which is provided with a lateral cut-out through which parts of the metering valve extend. It is hereby additionally possible to offset the optical axis of the lens in the direction of the discharge opening of the metering valve. At the same time, the imaging of the light spot thereby becomes more prominent and the desired positioning thereby becomes more precise due to the cut-out provided in the lens.

It can furthermore be advantageous if the metering valve has a liquid passage which opens at its one end into the discharge opening, with the liquid passage having a deflection section which intersects the optical axis of the beam device. In this way, the liquid to be metered can be guided into the region of the optical axis of the beam device so that the liquid drop can then cover a trajectory which lies on the optical axis or essentially in the region of the optical axis of the beam device.

In accordance with a further advantageous embodiment, the light marking can include a light spot which is provided with a structure. Such a structure is, for example, understood as an asymmetrical light spot, a divided light spot or a light region provided with another structure which makes it easier for the human eye or a sensor to carry out a precise adjustment. Such a light spot provided with a structure can, for example, be generated in that the lens is covered over a specific portion or is provided with a notch so that a picture element which has a gap, for example, is generated on the surface on which the liquid drop should impact.

In accordance with a further advantageous embodiment, the metering valve can be made as a manually manageable hand-held device since the impact point can easily be recognized with the aid of the beam device so that liquid drops can also be positioned in that the metering valve is held by an operator so that the focused light spot and the desired impact spot coincide.

In accordance with a further advantageous embodiment, the beam device can have a radiation source which transmits a radiation in the non-visible spectrum in the region of the liquid drop being discharged. In this embodiment, liquids which are opto-active can be actively influenced with the aid of the radiation source. For example, adhesives which cure under UV radiation can be acted on by a pulse of UV radiation after application of the liquid drop so that an accelerated curing of the adhesive point is achieved. In the same way, it is possible to direct radiation pulses to the applied liquid drop which lie in the infrared spectrum or in other wavelength ranges.

In a method in accordance with the invention for the operation of a metering valve of the kind described above, a radiation can be directed onto the discharged liquid drop after the control of the valve and after the discharge of a liquid drop said radiation lying in the visible spectrum or in the non-visible spectrum to physically influence the applied liquid drop.

BRIEF DESCRIPTION OF THE DRAWINGS

The present invention will be described in the following purely by way of example with reference to an advantageous embodiment and to the enclosed drawings. There are shown.

DETAILED DESCRIPTION

Figure 1:
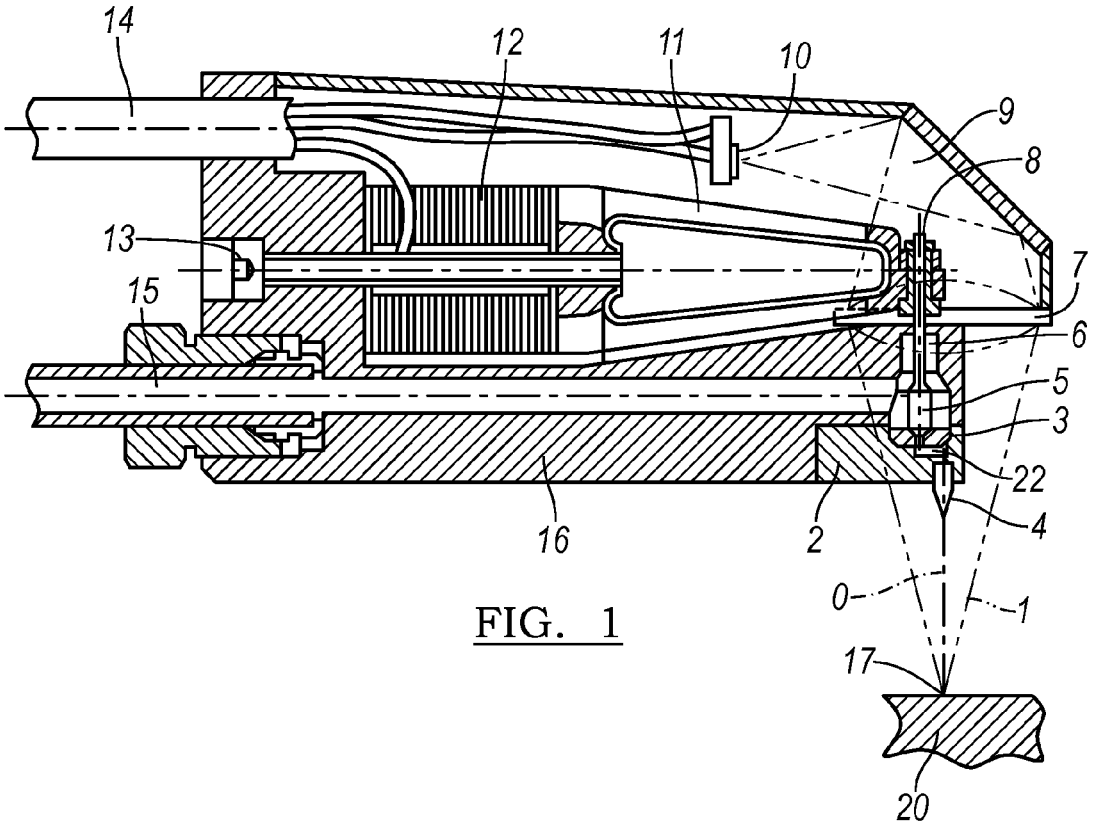
FIG. 1 a sectional view through a metering valve.

The metering valve shown in FIG. 1 has a housing 16 in which a liquid passage 15 is provided with which a liquid can be guided under pressure to a discharge nozzle 4, with a closure element being provided in the liquid passage 15 in the form of a sealing ball 5 which is pressed toward a sealing seat 3 by a valve needle 6. The valve needle 6 in FIG. 1 is moved to and fro in the vertical direction via a lever 11 in a manner known per se with the aid of a piezo drive 12 which is fastened to the housing 16 using clamping screws 13 so that the sealing ball 5 is periodically raised from the sealing seat 3 and the pressurized liquid can be discharged from the nozzle 4 in drop form.

The metering valve shown in FIG. 1 furthermore has a beam device which includes in the embodiment shown a radiation source 10 in the form, for example, of an LED diode or of a laser diode as well as a mirror 9 and a lens 7. Visible or non-visible radiation 1 is radiated from the light source 10 in the direction of the minor 9, is deflected by approximately 90° there and is directed to the lens 7 which is substantially circular (cf. FIG. 2). The radiation 1 is then focused by the lens 7 and is directed along the optical axis O of the beam device onto a surface 20. In this respect, the optical axis O extends coaxially to the trajectory of the liquid drops being discharged, i.e. the central axis of the discharge nozzle 4 and the optical axis O extend substantially coaxially.

Figure 2:
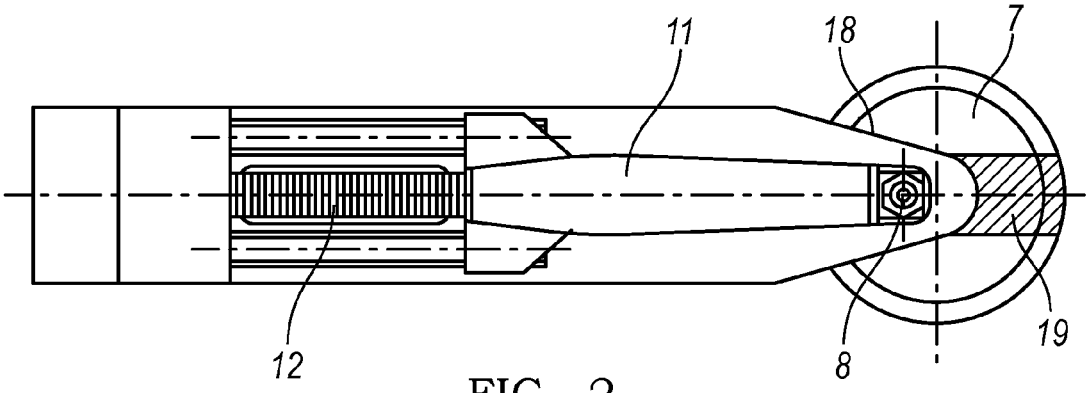
FIG. 2 a plan view of the metering valve of FIG. 1.

As FIG. 1 and FIG. 2 make clear, the lens 7 is a circular plastic lens with a circumferential middle web, with an approximately V-shaped cut-out 18 (FIG. 2) being formed in the lens 7 through which the lever 11, a needle fastening 8 and the valve needle 6 extend. The lens can equally be provided with a diaphragm 19 which can also be formed in the shape of a notch or the like in order to produce a gap or the like in the picture element generated on the surface 20 with which the adjustment of the metering valve is facilitated.

The reference symbol 14 designates an electrical connection for the piezo drive and for the light source 10.

As furthermore FIG. 1 makes clear, the liquid passage 15 first opens at its one end into the sealing seat 3 closed by the sealing ball 5, with a transverse passage 22 adjoining the sealing seat, said transverse passage being formed in a sealing seat carrier 2 and extending transversely to the central axis of the valve needle 6. At the same time, the transverse passage 22 intersects the optical axis O at a right angle, with the nozzle 4 which in turn extends transversely to the transverse passage 22 being provided in the region of the point of intersection. The transverse passage 22 thus serves as a deflection passage to set the discharge point of the liquid drops onto the optical axis O.

The light point generated by the light source 10 can be used for the installation and adjustment or for the alignment of the described metering valve. The spacings between the light source 10 and the lens 7 are selected in this respect in the manufacture of the metering vale while taking account of the deflection mirror 9 such that the focal point 17 coincides with the impact point of the liquid on the surface 20 best suited for the application of the respective liquid, i.e. the ideal spacing between the nozzle 4 and the surface 20 is set in that the metering valve is aligned such that the focused light marking comes to lie at the desired impact point.

When the metering valve described above is mounted stationary, it can moreover be used to influence opto-active liquids in that the radiation source 10 is activated after a liquid drop has impacted on the target surface 20. For example, a UV radiation pulse can be directed to the liquid drop so that it cures in an accelerated manner.

The invention claimed is:

1. A metering valve for the application of liquids which has a discharge opening (4) which can be closed by a closure element (5) and from which liquid drops are discharged on the opening of the valve, wherein the valve has a beam device which generates a beam of electromagnetic radiation in a region of the liquid drop being discharged, wherein the beam device has a lens (7) through which at least one part (6, 11) of the valve extends.

2. A metering valve in accordance with claim 1, wherein an optical axis of the beam device and a discharge direction of the liquid drop substantially coincide.

3. A metering valve in accordance with claim 1, wherein the beam device has a light source (10) and a lens (7) which generate a visible marking in the region of the liquid drop being discharged.

4. A metering valve in accordance with claim 1, wherein the beam device has a lens (7) with a lateral cut-out (18) in which a part of the valve (6, 11) is arranged.

5. A metering valve in accordance with claim 1, wherein it has a liquid passage (15) which opens at its one end into the discharge opening (4); and wherein the liquid passage has a deflection section (22) which intersects an optical axis of the beam device.

6. A metering valve in accordance with claim 3, wherein the visible marking includes a light spot provided with a structure.

7. A metering valve in accordance with claim 1, wherein it is made as a manually manageable hand-held device.

8. A metering valve in accordance with claim 1, wherein the beam device has a radiation source (10) which transmits a radiation in the non-visible spectrum in the region of the liquid drop being discharged.

9. A metering valve in accordance with claim 1, wherein the beam device generates radiation pulses.

10. A metering valve for the application of liquids which has a discharge opening (4) which can be closed by a closure element (5) and from which liquid drops are discharged on the opening of the valve, wherein the valve has a beam device which generates a beam of electromagnetic radiation in the region of the liquid drop being discharged, wherein the beam device has a lens (7) with a lateral cut-out (18) in which a part of the valve (6, 11) is arranged.

* * * * *